United States Patent [19]

Lewis

[11] Patent Number: 4,823,995

[45] Date of Patent: Apr. 25, 1989

[54] CONTAINER CAP

[75] Inventor: Duane H. Lewis, Claysville, Pa.

[73] Assignee: Continental Plastics, Inc., Triadelphia, W. Va.

[21] Appl. No.: 140,367

[22] Filed: Jan. 4, 1988

[51] Int. Cl.[4] ..... B65D 47/08

[52] U.S. Cl. ..... 222/545; 222/550; 222/555; 222/543; 222/541

[58] Field of Search ..... 222/541, 543, 545, 548, 222/555, 549, 550; 220/253, 375, 266

[56] References Cited

U.S. PATENT DOCUMENTS

| | | | |
|---|---|---|---|
| 844,640 | 2/1907 | West | 222/541 |
| 1,128,948 | 2/1915 | Chellis | 222/541 X |
| 1,391,771 | 9/1921 | Dunham . | |
| 2,106,364 | 1/1938 | Thorn | 221/64 |
| 2,108,063 | 2/1938 | Hothersall | 221/64 |
| 2,954,148 | 9/1960 | Corrinet et al. | 222/541 |
| 3,018,931 | 1/1962 | Westgate | 222/480 |
| 3,160,325 | 12/1964 | Stull | 220/266 X |
| 3,239,111 | 3/1966 | La Croce | 222/480 |
| 3,260,426 | 7/1966 | Ayotte | 222/548 X |
| 3,268,125 | 8/1966 | Waldrum | 222/541 X |
| 3,317,087 | 5/1967 | Landis | 222/143 |
| 3,463,364 | 8/1969 | Rehag | 222/548 X |
| 3,998,354 | 12/1976 | Song | 222/541 X |
| 4,613,063 | 9/1986 | Wright | 222/153 |
| 4,655,363 | 4/1987 | Neat | 220/375 X |

FOREIGN PATENT DOCUMENTS

| | | | |
|---|---|---|---|
| 2182027 | 5/1987 | United Kingdom | 222/548 |

*Primary Examiner*—Joseph J. Rolla
*Assistant Examiner*—Nils E. Pedersen
*Attorney, Agent, or Firm*—Richard V. Westerhoff

[57] ABSTRACT

A one piece, resilient, integrally molded container cap consisting of a rotor member, fixed member and a frangible connecting tab. The rotor member has a closed portion and an opening portion, and the fixed member has a closed portion and a sifting and pouring opening. As manufactured, the rotor member is attached to the fixed member by a frangible connecting tab. When desired to attach the container cap to a container, the rotor member is pivoted along the frangible connecting tab to be axially displaced from the fixed member. The rotor member is then pushed down on the fixed member, the members engaging each other by complementary locking surfaces. This action insures that the closed portions of the rotor and fixed members are aligned to prevent the contents of the container from undesired escape and also effects a tight, secure fit of the rotor member to the fixed member. When it is desired to dispense the contents of the container, the rotor member is rotated to sever the frangible connecting tab, and the opening portions of the rotor and fixed members are aligned thus allowing dispensing of the contents of the container.

12 Claims, 5 Drawing Sheets

CONTAINER CAP

BACKGROUND OF THE INVENTION

1. Field of the Invention

This invention relates to a container cap, and more particularly to a container cap having a rotatable rotor member that is attached to a fixed member by a frangible tab.

2. Description of the Prior Art

It is well known in the art to provide containers with caps that have a fixed bottom member having opened and closed portions along with a rotatable top member with opened and closed portions to facilitate dispensing of the contents of the container by pouring or sifting. See e.g. U.S. Pat. Nos. 3,239,111 and 4,613,063.

It is also known to provide a container with a fixed top member with an opening and a rotatable bottom member with an opened and closed portion so as to facilitate dispensing of the contents of the container. See U.S. Pat. No. 2,108,063.

With prior art devices, there is the need to inspect the caps before shipment to insure that the closed portions of the top and bottom members are aligned. If the open portions of the top and bottom members are aligned, the product can escape from the container before the container reaches the grocery store or household shelf. Also prior art devices do not effect a tight, reliable seal for the container in order to prevent the contents of the container from escaping. Therefore, there remains a need for a container cap that can be manufactured so that the closed portions of the top and bottom members are aligned when the cap is manufactured to insure that when the container with the product inside is shipped, that the product will not escape from the container. Also, there remains a need for a container cap that can eliminate the extra production step of aligning the top and bottom members before the container leaves the factory.

SUMMARY OF THE INVENTION

The container cap of the invention has solved the above need. The container cap has a fixed member having a circular end wall and a cylindrical skirt depending from the periphery of the end wall and a rotor member including a disc defining in one sector thereof an outlet. The fixed member and the rotor member define axially engageable locking elements securing the rotor member to the fixed member with the disc rotatable against the end wall between an open position wherein the outlet in the disc is aligned with the dispensing openings in the end wall and a closed position wherein the dispensing openings and the outlet are out of alignment. The fixed member and the rotor member are further joined by a connecting tab about which the rotor member is pivotable relative to the fixed member to axially engage the locking elements and secure the rotor member to the fixed member with the rotor member in a closed position. The tab is designed to fold inwardly of the circumferential surface of the container cap so as to not interfere with the container cap assembly. A sealing lip is provided which also insures a tight fit between the rotor member and the fixed member. Further, the tab is frangible to permit rotation of the rotor member relative to the end wall from the closed position.

It is an object of the invention to provide a container cap having a rotor member rotatably secured to a fixed member that facilitates dispensing product inside a container.

It is further object of the invention to provide the rotor member with a closed portion and an open portion.

It is a further object of the invention to provide the fixed member with a closed portion, a sifting opening and a pouring opening.

It is a further object of this invention to provide a container cap that can be manufactured so that the closed portions of the rotor and fixed members are aligned by virtue of a frangible tab connecting the rotor and fixed members.

It is a further object of this invention to provide sealing ribs on the closed portion of the fixed member to facilitate sealing of the rotor member to the fixed member.

It is a further object of the invention to provide a container cap that is easily and inexpensively manufactured.

It is a further object of the invention to provide a reliable way to insure that the contents of a container do not escape the container before intended dispensing of the contents by the ultimate consumer.

It is a further object of the invention to provide a container cap that eliminates the need, on the production or filling line, to inspect and align the cap to insure that the finished product is securely sealed so that no product will escape the frangible container.

These and other objects of the invention will be fully understood from the following description of the invention with reference to the drawings appended to this Application.

DESCRIPTION OF THE PREFERRED EMBODIMENT

Figure 1:
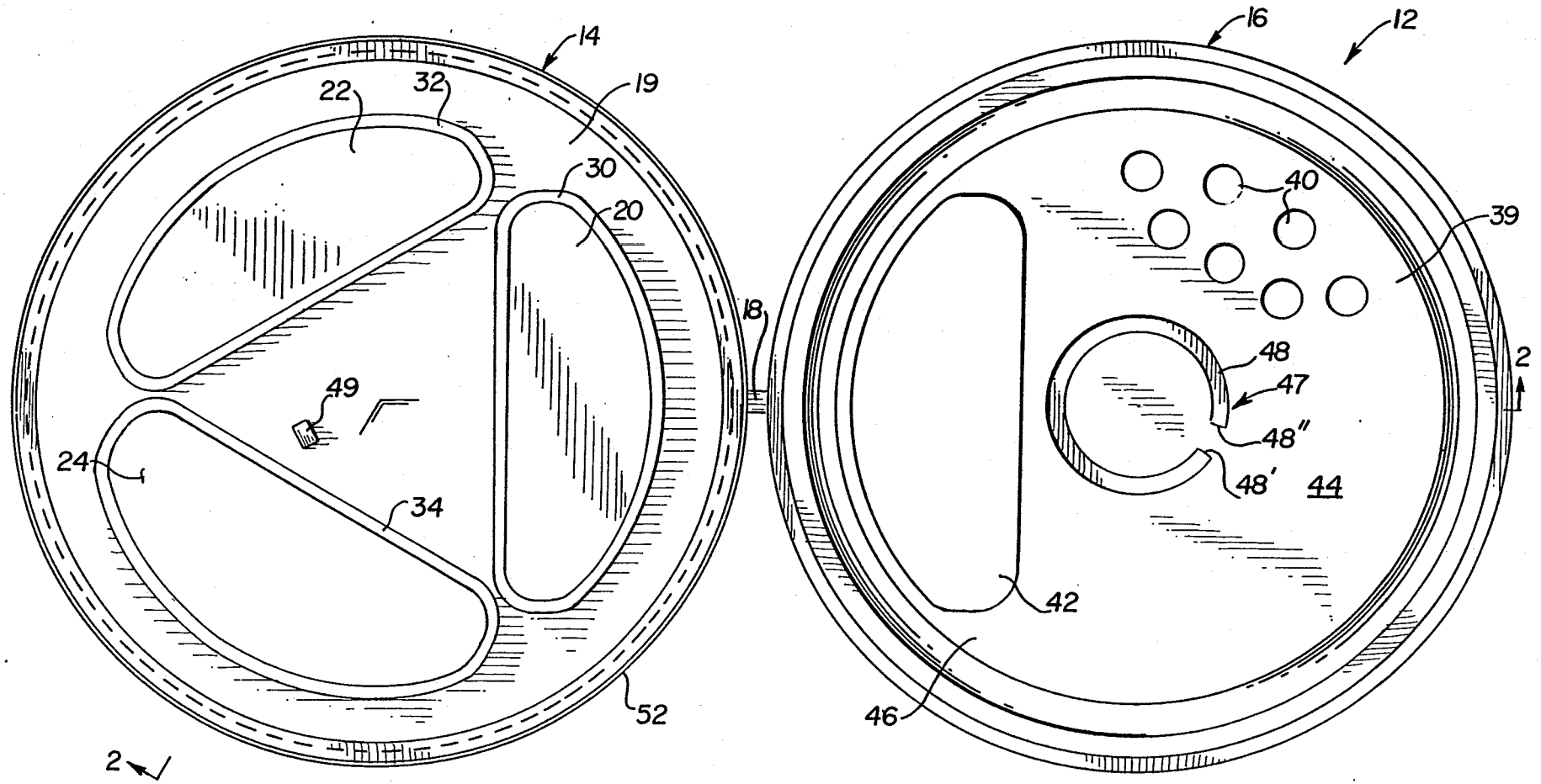
FIG. 1 is a top plan view of the container cap showing the rotor and fixed members as initially manufactured in its integrally molded state to form the completed container cap that goes on the container.
Figure 2:
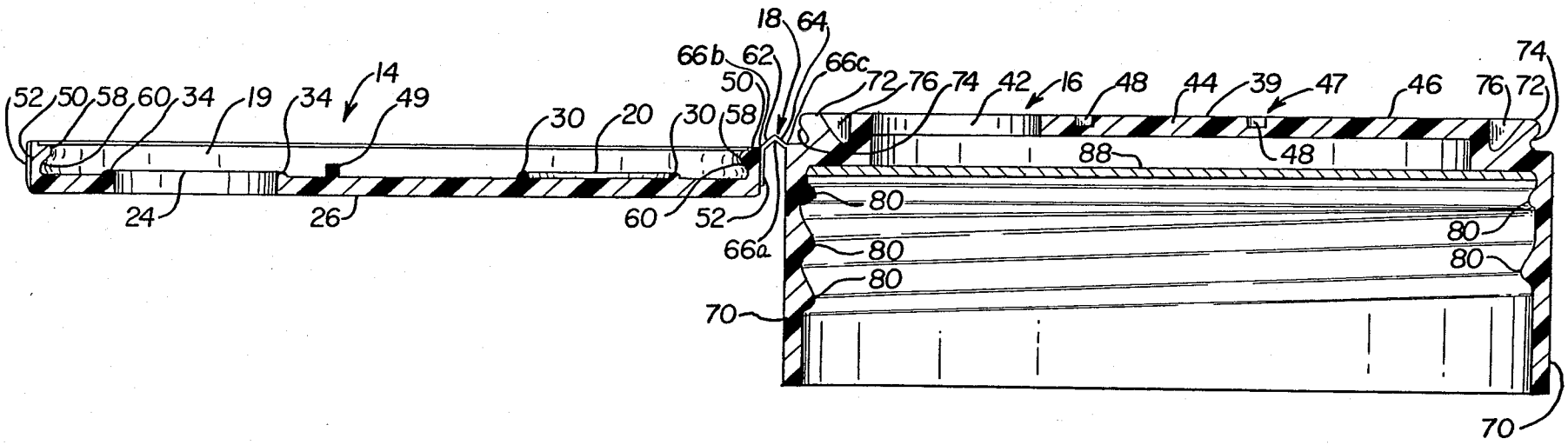
FIG. 2 is a cross-sectional view taken along line 2—2 of FIG. 1.

Referring now to FIGS. 1 and 2, and more specifically now to FIG. 1, the container cap 12 is shown. The container cap 12 is manufactured as an integrally molded one piece unit consisting of a rotor member 14, a fixed member 16 and a frangible connecting tab 18. FIGS. 1 and 2 show the container cap 12 before it is assembled and before it is placed on a container (not shown). The fixed member 16, rotor member 14 and tab 18 are preferably made of resilient resinous materials such as, for example, polypropolene, and are integrally formed by injection molding or other similar processes well known to those skilled in the art.

The rotor member 14 is preferably circular and includes a disc 19 which has three sectors 20, 22 and 24 that are defined by raised seals 30, 32 and 34 respectively. The function of the seals 30, 32 and 34 will be explained below. Sector 24 is an opening in the rotor member 14 which functions as an outlet for dispensing the product housed in the container.

The fixed member 16 is preferably circular and includes an end wall 39 which preferably has a plurality of sifting openings 40 and a spoon or pouring opening 42. It will be appreciated that preferably the surface 44 of the fixed member 16 is divided approximately into three sectors, with the sifting openings 40 comprising one third of the surface or one sector thereof, the pouring openings 42 comprising a second third of the surface or a second sector thereof and the third one third of the surface or a third sector thereof being a closed portion having no openings 46.

FIGS. 1 and 2 also show the rotation track means 47, which consists of a discontinuous annular groove 48 formed in the fixed member 16 and an axial projection 49 on the rotor member 14. When the container cap 12 is assembled, the projection 49 will engage the groove 48, so that when the rotor member 14 is rotated, the projection 49 in concert with the discontinuous groove 48 will act to fix the position of rotor member 14 vis-a-vis the fixed member 16. The groove 48 is designed so that when one side of the projection 49 touches the edge 48'' the container cap 12 will be in its "closed position" (as will be explained below) so that no product can escape the container. When the opposite side of projection 49 touches edge 48' the container cap is in its open (pour) position.

FIG. 2 shows a cross-sectional view along line 2—2 of FIG. 1. As can be seen, the rotor member 14 has an opening 24 in its surface 26 and a raised lip 30 defining a sector 20 of the surface of the rotor member 14. The raised lip 30 is preferably arcuate in cross-sectional shape and in the exemplary embodiment has a radius ranging from about 0.010 to 0.025 inches with a preferred radius of about 0.020 inches and a width ranging from 0.010 to 0.207 inches and preferred width of about 0.030 inches. An annular skirt 50 is also provided on the rotor member 14 which preferably has serrations 52 which facilitate gripping by the user of the rotor member 14.

As can further be seen in FIG. 2, the skirt 50 depends from the periphery of the rotor member 14 and defines means for securing the rotor member 14 to the fixed member 16. The rotor member 14 has means that preferably consist of an annular axially projecting and radially inwardly extending portion 58 forming a tapered undercut lip surface 60. This portion 58 is designed to snap-on to a complementary portion of the fixed member 16 as will be explained further below.

Figure 4:
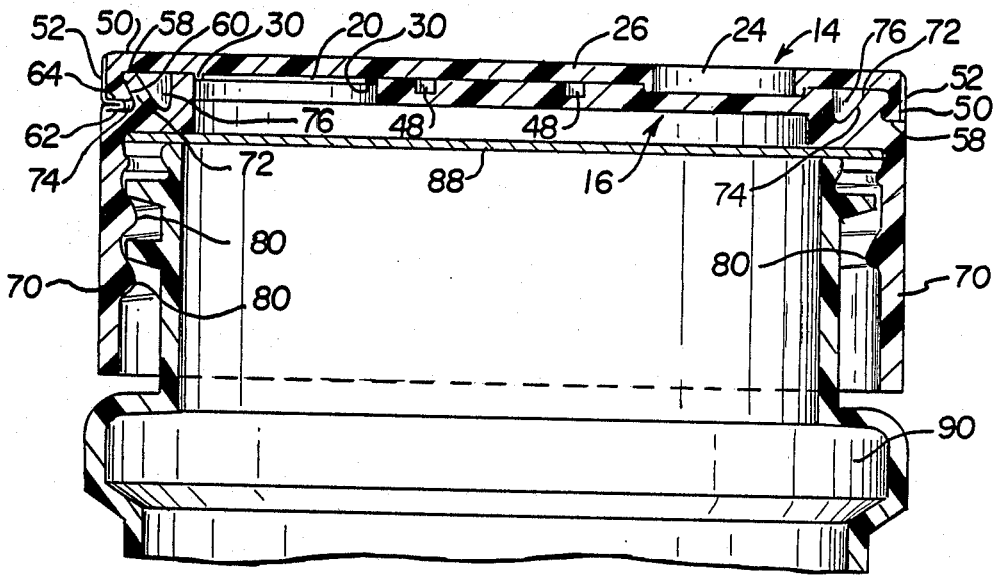
FIG. 4 is a vertical section through the cap showing the rotor member assembled with the fixed member and showing the rotor member pushed down on the fixed member with the tab folding inwardly.

The fixed member 16 has an annular axially projecting radially outwardly extending portion 72 which forms a tapered open cut surface 74. An annular groove 76 may also be provided to facilitate manufacture of the rotor member 16 and which may also form an additional sealing edge between the rotor and fixed members. The skirt 70 is provided with threads 80 that engage complementary threads 82 (See FIG. 4) on the container. An optional removable or frangible liner 88 can be provided in order to further seal the container.

The tapered surfaces 60 and 74 are complementary and act to draw the rotor member 14 downwardly towards the fixed member 16 in locking engagement when the rotor member 14 is assembled with the fixed member 16. The container cap 12 is made of resilient materials in order to facilitate complementary engagement of the rotor member 14 to the fixed member 16 by means of portions 58 and 72. When assembled, the sealing lips 30, 32 and 34 are also drawn down to provide a tighter fit between the fixed member 16 and rotor member 14. This also will prevent undesired leakage of materials from the container.

The frangible connecting tab 18 is preferably formed in two sections 62 and 64 which project axially and radially from the rotor member 14 and fixed member 16 respectively to define a hinge axis **66*a*. Sections 62 and 64 also can pivot about additional pivot axes 66*b* and *c* at the respective points that they join the rotor member 14 and fixed member 16. The tab has a thickness that ranges from about 0.005 to 0.060 inches, preferably 0.005 inches and a width that ranges from about 0.010 to 0.250 inches, with 0.062 inches being the preferred width depending on the material used to make the tab 18**.

The tab 18 axially spaces the rotor member 14 from the fixed member 16 when the rotor member 14 is pivoted into axial alignment with the fixed member 16 as will be explained below. The line segments formed by the hinge axes 66 are preferably parallel to the planes of the rotor member 14 and fixed member 16. One of the hinge axes **66*b* or *c* may be a score line to facilitate fracturing of the frangible connecting tab 18. This will facilitate rupturing of the frangible connecting tab 18 when the rotor member 14 is rotated relative to the fixed member 16**.

Figure 3:
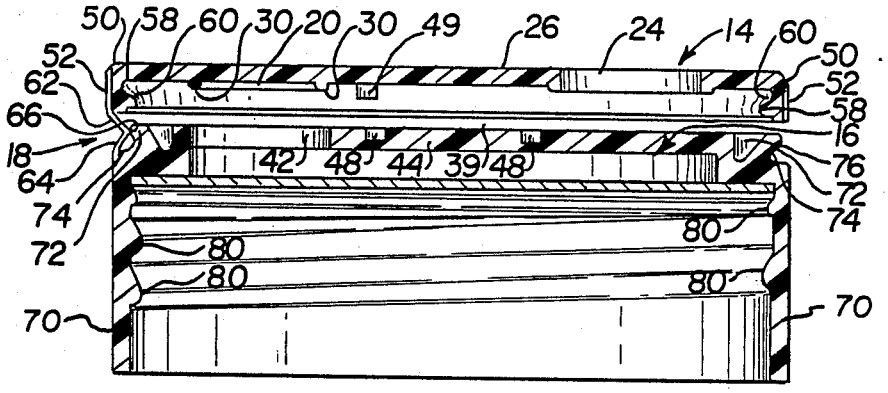
FIG. 3 is a side view shown as a section of the cap showing the rotor member pivoted to a position axially spaced from the fixed member and before the rotor member is pushed down onto the fixed member.

Referring to FIGS. 2–5 the operation of the frangible connecting tab 18 and the assembling of the rotor member 14 onto the fixed member 16 will be explained. The rotor member 14 is pivoted to a point where the rotor member 14 is axially aligned but spaced from the fixed member 16 as shown in FIG. 3. The rotor member 14, thus, starts in an upside down position relative to the fixed member and is pivoted to a right-side-up position. Note that the frangible connecting tab 18 is still intact, but is merely pivoted to a different position.

Once the rotor member 14 is in its axially displaced right-side-up position over the fixed member 16 as shown in FIG. 3, the rotor member 14 is then pushed down onto the fixed member 16. The sections 62 and 64 bend inwardly and fit into the opened tapered area portion 74 of fixed member 16. This way the tab 18 will not project from the side of the container cap 10. Two objectives are accomplished by the "pushing down" action: one, the rotor member 14 is properly aligned in a closed position onto the fixed member 16 so as to prevent undesired leakage from the container because the opening sector 24 in the disc is aligned with the closed portion 46 of the end wall 39, and two, the tapered surfaces on the complementary portions 58 and 72, after the rotor member 14 is pushed down on the fixed member 16, draw the rotor member 14 and the fixed member 16 together providing a tighter fit which further insure container integrity. Such action also presses the sealing lips on the rotor member 14 against the fixed member 16. If desired, the sealing lips can be provided on the fixed member 16 rather than the rotor member 14.

The tab 18, after the rotor member 14 has been pushed down onto the fixed member 16, will be able to fracture along either axis 66*b* or *c* where the sections 62 and 64 join their respective members. But, preferably the tab 18 remains intact until reaching the hands of the ultimate consumer who will fracture the frangible connecting tab 18 upon rotating the rotor member 14 relative to the fixed member 16. This provides additional container cap integrity and prevents tampering with the contents of the container.

Figure 5:
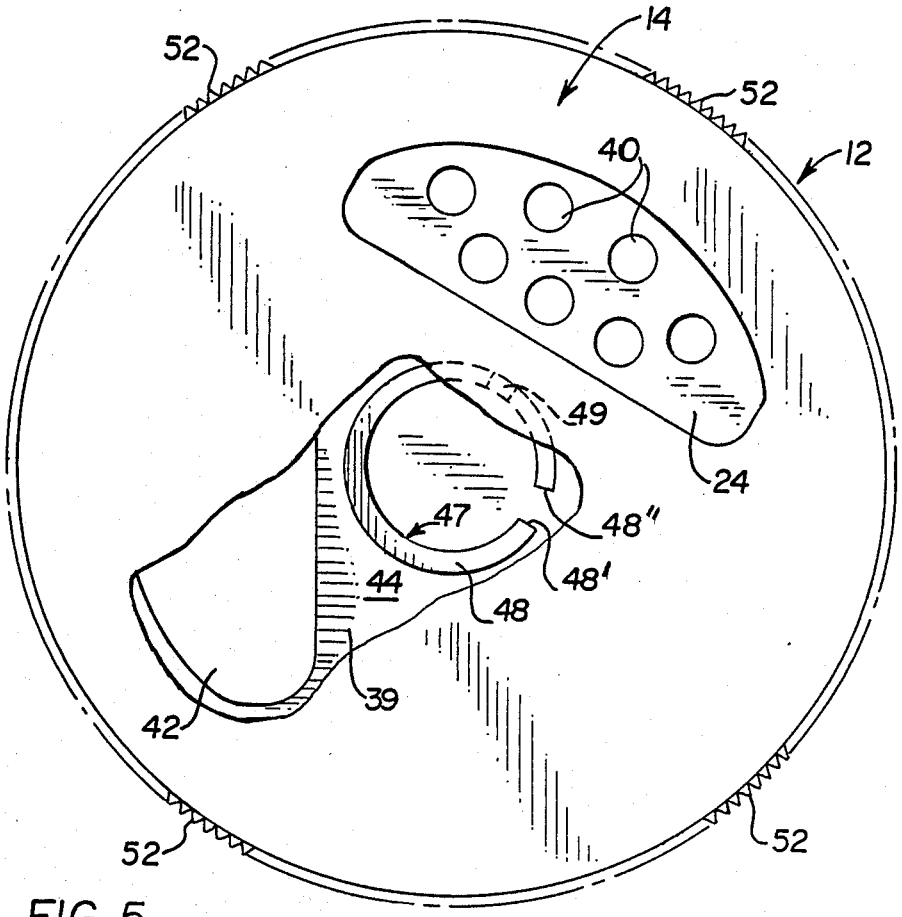
FIG. 5 is top plan view, with parts broken away, of the container cap showing the rotor member assembled with the fixed member.

FIG. 5 shows a top view of the container cap after the rotor member 14 has been flipped over on to the rotor member 16, and rotor member 14 rotated to an open position so that the opening sector 24 is rotated to expose the sifting openings 40 of the fixed member 16. This view also shows the rotation track means 47, with the projection 49 shown as being displaced about 240 degrees from the position it was in when the container cap 12 was first assembled by pivoting the rotor member 14 onto the fixed member 16 as described above.

In use, the rotor member 14 is rotated by engaging the skirt 50 of the rotor member 14. The rotor member 14 is rotated until either the sifting opening 40 or the pouring opening 42 of the fixed member 16 is aligned with the opening sector 24 of the rotor member 14. The contents of the container 90 are then ready for dispensing.

Figure 6:
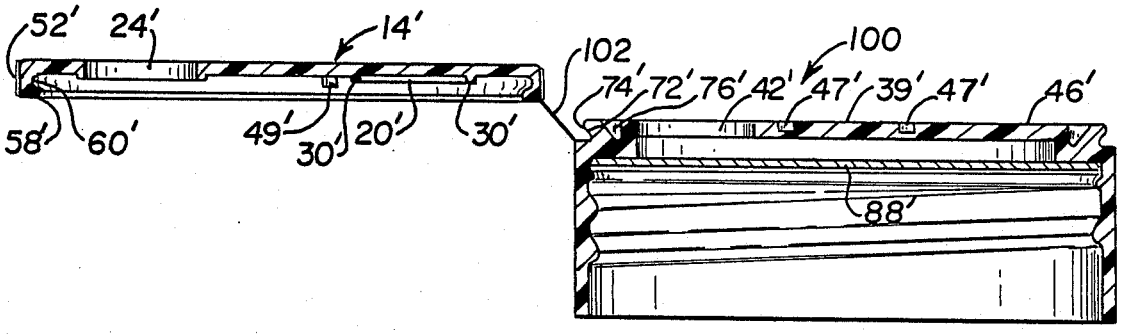
FIG. 6 is a side elevational view of another embodiment of the container cap.
Figure 7:
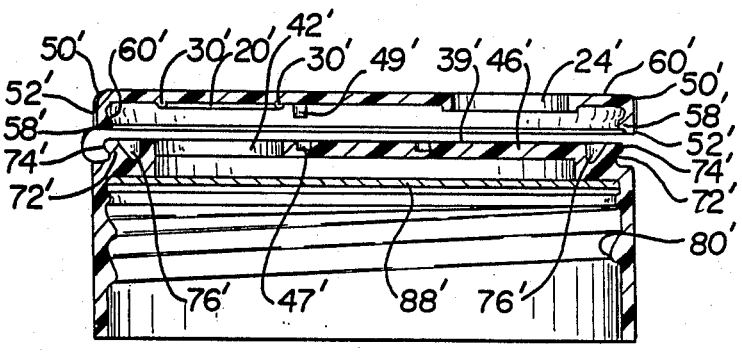
FIG. 7 is a side elevational view of the embodiment of FIG. 6 showing the rotor member rotated to a position axially spaced from the fixed member and before the rotor member is pushed down onto the fixed member.

FIGS. 6 and 7 illustrate another embodiment of the container cap 100. Reference numbers having a prime superscript (such as 14' and 16') represent corresponding parts of this embodiment and the embodiment described hereinabove.

In the embodiment shown in FIGS. 6 and 7, the rotor member 14' and the fixed member 16' are joined by frangible connecting tab 102. The rotor member 14' is positioned so that it does not have to be flipped over onto the fixed member 16', but instead is positioned so that it can be rotated to a position over top of the fixed member 16'. The rotor member 14' is rotated approximately 180 degrees to a position axially spaced from the fixed member as is shown in FIG. 7. During this rotation, the tab 102 twists but remains intact.

As before, once the rotor member 14' is axially spaced from the fixed member 16', it is then pushed down onto the fixed member 16'. The tab 102 is preferably left intact, but may also be fractured by this pushing down action.

The difference in the tab 102 from the tab 18 discussed hereinabove is that tab 102 does not have a hinge axis 66 which is parallel to the plane of the rotor member 14' and fixed member 16'. Tab 102 is integrally formed, and allows the rotor member 14' to pivot on an axis which is, in fact, substantially to the planes of rotor member 14' and fixed member 16'.

The same objectives are achieved with container cap 100 as with the container cap 12 embodiment discussed hereinabove.

Figure 8:
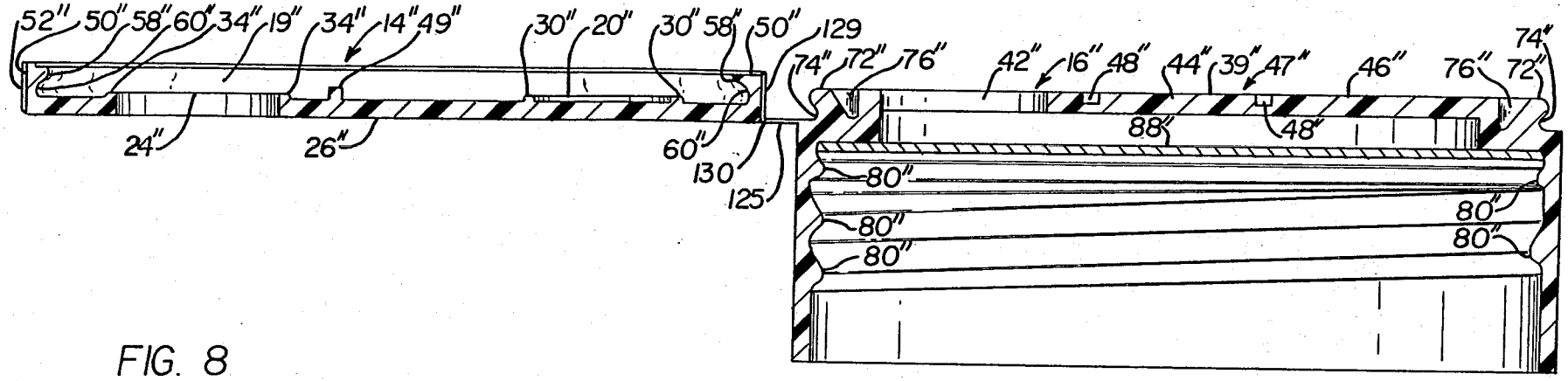
FIG. 8 is a side elevational view of another embodiment of the container cap.
Figure 9:
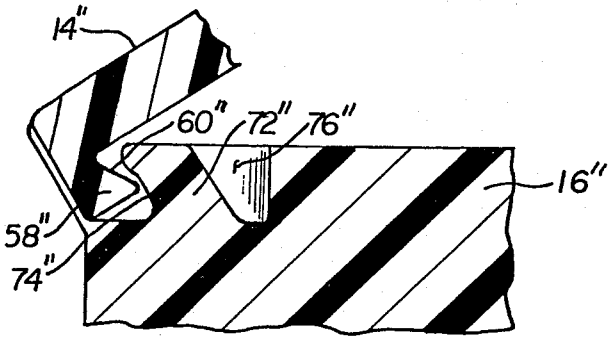
FIG. 9 is a side elevational view of the embodiment of FIG. 8 showing rotor member pivoted areas onto the fixed member, with the tab disappearing into the slot on the rotor member.

That is, the 180 degree rotation of the rotor member 14' insures that it is properly aligned in a "closed" position onto the fixed member 16' so as to prevent undesired leakage from the container. This is because the opening sector 24' of the rotor member 14' is aligned with the closed portion 46' of the fixed member 16' and the complementary portions 58' and 72', after the rotor member 14' is pushed down onto the fixed member 16', provide a tighter fit and also bring the sealing lips 30' on the rotor member A further embodiment of the container cap is shown in FIGS. 8 and 9. Reference numbers having a double prime superscript (14'' and 16'') represent corresponding parts of this embodiment and the embodiment described hereinabove.

In this embodiment, the rotor member 14'' and the fixed member 16'' are joined by frangible connecting tab 25. The rotor member 14'' is positioned so that it must be flipped over onto the fixed member 16'', as is similar to the 15 embodiment shown in FIGS. 1–5. The tab 125 is approximately as long as the edge portion 129 of the rotor member 120. The tab 125 is designed to fit into an axial slot 130 on the rotor member 120 when the rotor member 120 is flipped over onto the fixed member 16'', as is shown in FIG. 9.

As with the other two embodiments, this structure provides a method of preventing undesired leakage and providing a tighter seal between the rotor and fixed members. This embodiment has the added feature that the tab 125 can be shorter in length than the tabs of the other embodiments, and that the tab 125 can disappear into the slot 130 upon assembly of the rotor and fixed members.

It will be appreciated that the container cap is a product that is easily manufactured and provides a reliable efficient method of insuring that the contents of a container do not escape before reaching the hands of the ultimate consumer.

Whereas a particular embodiment of the invention has been described above, for purposes of illustration, it will be evident to those skilled in the art that numerous variations of the details may be made without departing from the invention as defined in the appended claims.

What is claimed:

1. A container cap comprising:

a fixed member having a circular end wall and a cylindrical skirt depending from the periphery of the end wall, said skirt defining means for securing the fixed member to a container and said end wall defining in at least one sector thereof dispensing openings, a rotor member including a disc defining in one sector thereof an opening sector, said fixed member and rotor member defining axially engageable locking elements securing the rotor member to the fixed member with the disc rotatable against said end wall between an open position wherein the opening sector in the disc is aligned with the dispensing openings in the end wall and a closed position wherein the dispensing openings and said opening sector are out of alignment, a tab joining the rotor member to the fixed member and defining at least one hinge axis about which the rotor member is pivotable relative to said fixed member to axially align said locking elements of said rotor member and fixed member for engagement with said rotor member in said closed position, said tab being frangible to permit rotation of the rotor member relative to the fixed member, and said tab comprising tab sections projecting radially and axially from the rotor member and fixed member respectively to define said hinge axis axially spacing the rotor member from the fixed member with the rotor member pivoted into axial alignment with the fixed member, said tab being folded inwardly so that said tab does not project beyond the outside of said rotor means.

2. The container cap of claim 1 including said tab having said hinge axis substantially parallel to said circular end wall of said fixed member and said disc of said rotor member, whereby said rotor member may be rotated to a position axially aligned and spaced from said fixed member.

3. The container cap of claim 1, including said rotor member having sealing lip means, which define said opening sector, whereby when said rotor member is pushed down on to said fixed member, said sealing lip means provide a seal between said disc and said end wall around said opening sector.

4. The container cap of claim 3, including said sealing lip means being arcuate in cross section having a radius of about 0.010 to 0.025 inches and a width of about 0.010 to 0.207 inches.

5. The container cap of claim 4, including said sealing lip means having a radius of about 0.020 inches and a width of about 0.030 inches.

6. The container cap of claim 3, including said axially engageable locking elements consisting of an annular axially projecting radially outwardly extending portion having tapered surfaces on said fixed member and an annular axially projecting radially inwardly extending portion having a tapered surface on said rotor member, whereby said portions are complementary so as to draw said rotor member along with said sealing lip means into a tight secure fit with said fixed member.

7. The container cap of claim 6, including said sealing lip means surrounding said dispensing opening when said rotor member is drawn down to said fixed member.

8. The container cap of claim 1, including said fixed member having sealing lips means, which define at least one of said dispensing openings, whereby when said rotor member is pushed down on to said fixed member, said sealing lip means provide a seal between said disc and said end wall around said opening sector.

9. The container cap of claim 8, including said sealing lip means being arcuate in cross-section having a radius of about 0.010 to 0.025 inches and a width of about 0.010 to 0.207 inches.

10. The container cap of claim 9, including said sealing lip means having a radius of about 0.020 inches and a width of about 0.030 inches.

11. A container cap comprising:

a fixed member having a circular end wall and a cylindrical skirt depending from the periphery of the end wall, said skirt defining means for securing the fixed member to a container and said end wall defining in at least one sector thereof dispensing openings, a rotor member including a disc defining in one sector thereof an opening sector, said fixed member and rotor member defining axially engageable locking elements securing the rotor member to the fixed member with the disc rotatable against said end wall between an open position wherein the opening sector in the sic is aligned with the dispensing openings in the end wall and a closed position wherein the dispensing openings and said opening sector are out of alignment, a tab joining the rotor member to the fixed member and defining at least one hinge axis about which the rotor member is pivotable relative to said fixed member to axially align said locking elements of said rotor member and fixed member for engagement with said rotor member in said closed position, said tab being frangible to permit rotation of the rotor member relative to the fixed member, and said tab having said hinge axis substantially perpendicular to said circular end wall of said fixed member and said disc of said rotor member, whereby said rotor member may be rotated to a position axially aligned but spaced from said fixed members.

12. A container cap comprising:

a fixed member having a circular end wall and a cylindrical skirt depending from the periphery of the end wall, said skirt defining means for securing the fixed member to a container and said end wall defining in at least one sector thereof dispensing openings.

as rotor member including a disc defining in one sector thereof an opening sector.

said fixed member and rotor member defining axially engageable locking elements securing the rotor member to the fixed member with the disc rotatable against said end wall between an open position wherein the opening sector in the disc is aligned with the dispensing openings in the end wall and a closed position wherein the dispensing openings and said opening sector are out of alignment.

a tab joining the rotor member to the fixed member and defining at least one hinge axis about which the rotor member is pivotable relative to said fixed member to axially align said locking elements of said rotor member and fixed member for engagement with said rotor member in said closed position, said tab being frangible to permit rotation of the rotor member relative to the fixed member, and said tab having said hinge (a rotation) axis (that is) substantially perpendicular to said circular end wall of said fixed member and said disc of said rotor member, the planes of said rotor and fixed members,) whereby said rotor member may be rotated to a position axially aligned but spaced from said fixed members.

* * * * *

UNITED STATES PATENT AND TRADEMARK OFFICE

CERTIFICATE OF CORRECTION

PATENT NO. : 4,823,995

DATED : April 25, 1989

INVENTOR(S) : DUANE H. LEWIS

It is certified that error appears in the above-identified patent and that said Letters Patent is hereby corrected as shown below:

Col.5, line 64, --perpendicular-- should be inserted after "substantially".

Col.6, line 10, --14' into tight sealing engagement.-- should be inserted after "member".

Col.6, line 18, "25" should be --125--.

Col.6, line 20, "15" should be deleted.

Claim 11, col.8, line 11, "sic" should be --disc--.

Claim 12, col.8, line 35, "as" should be --a--.

Claim 12, col.8, lines 34,36,44, the periods should be commas

Claim 12, col.8, lines 53-59 should read as follows:
--said rotor member having an axial slot means disposed on the circumferential surface of said rotor member whereby when said rotor member is pivoted with respect to said fixed member, said tab is inserted into said slot.--

Signed and Sealed this

Seventeenth Day of October, 1989

*Attest:*

DONALD J. QUIGG

*Attesting Officer*

*Commissioner of Patents and Trademarks*